US005094589A

United States Patent [19]

Terauchi et al.

[11] Patent Number: 5,094,589

[45] Date of Patent: Mar. 10, 1992

[54] SLANT PLATE TYPE COMPRESSOR WITH VARIABLE DISPLACEMENT MECHANISM

[75] Inventors: Kiyoshi Terauchi; Seiichi Sakamoto, both of Guma, Japan

[73] Assignee: Sanden Corporation, Guma, Japan

[21] Appl. No.: 666,612

[22] Filed: Mar. 8, 1991

Related U.S. Application Data

[63] Continuation-in-part of Ser. No. 544,430, Jun. 27, 1990.

[30] Foreign Application Priority Data

Mar. 20, 1990 [JP] Japan ..... 2-68282

[51] Int. Cl.[5] ..... F04B 1/26

[52] U.S. Cl. ..... 417/222 S; 417/270

[58] Field of Search ..... 417/222 S, 222, 270

[56] References Cited

U.S. PATENT DOCUMENTS

| | | | |
|---|---|---|---|
| 4,428,718 | 1/1984 | Skinner | 417/222 S |
| 4,480,964 | 11/1984 | Skinner | 417/222 S |
| 4,526,516 | 7/1985 | Swain et al. | 417/222 S |
| 4,533,299 | 8/1985 | Swain et al. | 417/222 S |
| 4,606,705 | 8/1986 | Parekh | 417/222 S |
| 4,702,677 | 10/1987 | Takenaka | 417/222 S |
| 4,723,891 | 2/1988 | Takenaka et al. | 417/222 S |
| 4,730,986 | 3/1988 | Kayukawa et al. | 417/222 S |
| 4,732,544 | 3/1988 | Kurosawa et al. | 417/222 S |
| 4,747,753 | 5/1988 | Taguchi | 417/222 S |
| 4,780,059 | 10/1988 | Taguchi | 417/222 S |
| 4,780,060 | 10/1988 | Terauchi | 417/222 S |
| 4,842,488 | 6/1989 | Terauchi | 417/222 S |
| 4,875,832 | 10/1989 | Suzuki | 417/222 S |
| 4,878,817 | 11/1989 | Kikuchi | 417/222 S |
| 4,913,627 | 4/1990 | Terauchi | 417/222 S |
| 4,936,752 | 6/1990 | Terauchi | 417/222 S |
| 4,940,393 | 7/1990 | Taguchi | 417/222 S |
| 4,960,367 | 10/1990 | Terauchi | 417/222 S |

FOREIGN PATENT DOCUMENTS

| | | |
|---|---|---|
| 0255764 | 7/1987 | European Pat. Off. . |
| 0256334 | 7/1987 | European Pat. Off. . |
| 0258680 | 8/1987 | European Pat. Off. . |
| 0287940 | 4/1988 | European Pat. Off. . |
| 0300831 | 7/1988 | European Pat. Off. . |
| 0318316 | 11/1988 | European Pat. Off. . |
| 3731944A1 | 4/1988 | Fed. Rep. of Germany . |
| 58-158382 | 2/1958 | Japan . |
| 61-55380 | 3/1986 | Japan . |
| 62-276279 | 1/1987 | Japan . |
| 63-16177 | 1/1988 | Japan . |
| 63-29067 | 2/1988 | Japan . |
| 63-41677 | 2/1988 | Japan . |
| 64-29678 | 1/1989 | Japan . |
| 1-142276 | 6/1989 | Japan . |

*Primary Examiner*—Richard A. Bertsch
*Assistant Examiner*—Peter Korytnyk
*Attorney, Agent, or Firm*—Banner, Birch, McKie & Beckett

[57] ABSTRACT

A slant plate type compressor with a capacity or displacement adjusting mechanism is disclosed. The compressor includes a housing having a cylinder block provided with a plurality of cylinders and a crank chamber. A piston is slidably fitted within each of the cylinders and is reciprocated by a drive mechanism which includes a slant plate having a surface with an adjustable incline angle. The incline angle is controlled according to the pressure in the crank chamber. The pressure in the crank chamber is controlled by a control mechanism which comprises a first passageway linking the crank chamber and the suction chamber, and a valve device which controls the closing and opening of the first passageway. The valve device includes a valve element which directly controls the closing and opening of the first passageway, a first valve control device which controls the position of the valve element in response to pressure in the crank chamber, and a second valve control device which include a second passageway linking the crank chamber and the discharge chamber and an actuator disposed in the second passageway. The second valve control device controls the predetermined crank pressure operating point of the first valve control device. The operation of the second valve control device is controlled in response to changes in the thermodynamic characteristics of the refrigerant circuit so as to open and close the second passageway.

17 Claims, 6 Drawing Sheets

SLANT PLATE TYPE COMPRESSOR WITH VARIABLE DISPLACEMENT MECHANISM

This application is a continuation-in-part application of commonly assigned copending application Ser. No. 544,430 to Kiyoshi Terauchi, filed Jun. 27, 1990, the disclosure of which is hereby incorporated by reference in its entirety.

BACKGROUND OF THE INVENTION

1. Technical Field

The present invention relates to a refrigerant compressor, and more particularly, to a slant plate type compressor, such as a wobble plate type compressor, with a variable displacement mechanism, and suitable for use in an automotive air conditioning system.

2. Description of the Prior Art

Slant plate type piston compressors including a variable displacement or capacity adjusting mechanism for controlling the compression ratio of the compressor in response to demand are known in the art. For example, U.S. Pat. No. 3,861,829 to Roberts et al. discloses a wobble plate type compressor including a cam rotor driving device, and a wobble plate linked to a plurality of pistons. Rotation of the cam rotor driving device causes the wobble plate to nutate and thereby successively reciprocate the pistons in corresponding cylinders. The stroke length of the pistons and thus the capacity of the compressor may be easily changed by adjusting the slant angle of the wobble plate. The slant angle is changed in response to the pressure difference between the suction chamber and the crank chamber.

In a typical prior art compressor, the crank chamber and the suction chamber are linked in fluid communication by a path or passageway. A valve mechanism is disposed in the path and controls the link of the crank and suction chambers by opening and closing the path. The valve mechanism generally includes a bellows element having a needle valve thereon. The bellows is located in the suction chamber and operates in accordance with a change in the pressure in the suction chamber by expanding or contracting to move the needle valve into or out of a position where it opens or closes the path. That is, when the suction pressure is below a predetermined value, the bellows expands and the valve element closes the passageway, and when the suction pressure is above the predetermined value, the bellows contracts and the valve element opens the passageway.

When the passageway is open, the crank and suction chambers are linked, such that the crank and suction chamber pressures are generally equalized, and the slant angle of the wobble plate with respect to a plane perpendicular to the drive shaft increases. Therefore, the stroke length of the pistons increases towards the maximum value, and the capacity of the compressor increases as well. When the passageway is closed, the pressure within the crank chamber increases due to blow-by gas leaking past the pistons in the cylinders as the pistons reciprocate. The increase in pressure in the crank chamber with respect to the suction chamber pressure causes the slant angle of the wobble plate to be decreased, thereby reducing the stroke length of the pistons and decreasing the capacity of the compressor.

In this prior art, the suction pressure operating point of the valve mechanism at which it opens or closes the communication path is generally determined by the pressure of the gas contained within the bellows. Thus, the operating point of the bellows element is fixed at a predetermined value of the suction pressure. Therefore, the bellows element operates only due to a change of the suction pressure above or below the predetermined value, and is not responsive to various changes of the condition of the refrigeration circuit which includes the compressor, for example, changes in the thermal load of the evaporator of the refrigeration circuit.

One way of overcoming this drawback in the prior art is disclosed in U.S. Pat. No. 4,842,488 to Terauchi, which discloses a slant plate type compressor including a valve mechanism to control the communication between the crank chamber and the suction chamber through the communication path. The valve mechanism includes a first valve control device for controlling the communication between the crank and suction chambers. The first valve control device may be a bellows operating in response to the refrigerant pressure in the suction chamber. A second valve control device is coupled directly to the first valve control device, and controls the suction pressure operating point of the first valve control device in response to changes in external operating conditions, for example, the thermal load on the evaporator. The second valve control device may include an electrically activated solenoid. The current which is supplied to the solenoid, and thus the effect of the solenoid in changing the response point of the bellows, may be varied in accordance with the sensed external condition, for example, the thermal load of the evaporator. Therefore, the suction pressure response point of the bellows may be adjusted in accordance with the sensed external condition.

However, in the above discussed patent, the second valve control device is directly coupled to the first valve control device. Therefore, the effectiveness of the control of the operating point of the first valve control device which is provided by the second valve control device is reduced due to the inertial force generated by movement of the second valve control device, as well as the frictional force generated at the contact surfaces of the sliding portions of the second valve control device. Accordingly, the accuracy of the control provided by the second valve control device in adjusting the suction pressure response point of the bellows is decreased.

SUMMARY OF THE INVENTION

A slant plate type refrigerant compressor including a compressor housing enclosing a crank chamber, a suction chamber and a discharge chamber therein is disclosed. The compressor housing includes a cylinder block having a plurality of cylinders formed therethrough, and a piston slidably fitted within each of the cylinders. A drive mechanism is coupled to the pistons for reciprocating the pistons within the cylinders. The drive mechanism includes a drive shaft rotatably supported in the housing and a coupling mechanism which drivingly couples the drive shaft to the pistons such that rotary motion of the drive shaft is converted into reciprocating motion of the pistons. The coupling mechanism includes a slant plate having a surface disposed at an adjustable inclined angle relative to a plane perpendicular to the drive shaft. The inclined angle of the slant plate is adjustable to vary the stroke length of the pistons in the cylinders to vary the capacity of the compressor. A passageway is formed in the housing and links the crank chamber and the suction chamber in fluid communication.

The compressor further includes a capacity control device for varying the capacity of the compressor by adjusting the inclined angle. The capacity control device includes a valve control mechanism and a response pressure adjusting mechanism. The valve control mechanism controls the opening and closing of the passageway in response to changes in refrigerant pressure in the compressor to control the link between the crank and suction chambers to thereby control the capacity of the compressor. The valve control mechanism is responsive at a predetermined pressure. The response pressure adjusting mechanism controllably changes the predetermined pressure at which the valve control mechanism responds.

The response pressure adjusting mechanism includes a hollow portion, and a piston element disposed in the hollow portion and dividing the hollow portion into a first space open to the discharge chamber and a rear space isolated from the discharge chamber. The first and second spaces are linked by gaps formed between the inner surface of the hollow portion and an outer surface of the piston element. The piston element is linked to the valve control mechanism by an elastic element. A communicating path links the second space with the crank chamber. The response pressure adjusting mechanism further includes a second valve control mechanism for controlling the link of the second space to the crank chamber. The second valve control mechanism functions in response to an external signal to effectively vary the pressure in the second space between the discharge pressure and the crank pressure.

In a further embodiment, the compressor housing further includes a front end plate disposed at one end of the cylinder block and enclosing the crank chamber within the cylinder block, and a rear end plate disposed on the other end of the cylinder block. The discharge chamber and the suction chamber are enclosed within the rear end plate by the cylinder block. The coupling mechanism further includes a rotor coupled to the drive shaft and rotatable therewith, with the rotor further linked to the slant plate.

In a further embodiment, the compressor includes a wobble plate nutatably disposed about the slant plate. Each of the pistons is connected to the wobble plate by a connecting rod, and the slant plate is rotatable with respect to the wobble plate. Rotation of the drive shaft, rotor and slant plate causes nutation of the wobble plate, and nutation of the wobble plate causes the pistons to reciprocate in the cylinders.

The compressor of the present invention provides the advantage that the predetermined response pressure of the valve control mechanism is accurately controlled in accordance with changes in the thermodynamic conditions of the refrigeration circuit which includes the compressor. The effect of the inertia of the various moveable elements and the frictional force generated by movement of these elements is eliminated. Therefore, the capacity of the compressor can be controlled with a high degree of accuracy. In addition, when the capacity control mechanism functions to decrease the capacity of the compressor due to a decrease in the demand on the air-conditioning system of which the compressor forms a part, the decrease in capacity is achieved quickly due to the link between the second space and the crank chamber.

DETAILED DESCRIPTION OF THE PREFERRED EMBODIMENTS

In FIGS. 1–6, for purposes of explanation only, the left side of the figures will be referenced as the forward end or front of the compressor, and the right side of the figures will be referenced as the rearward end or rear of the compressor.

Figure 1:
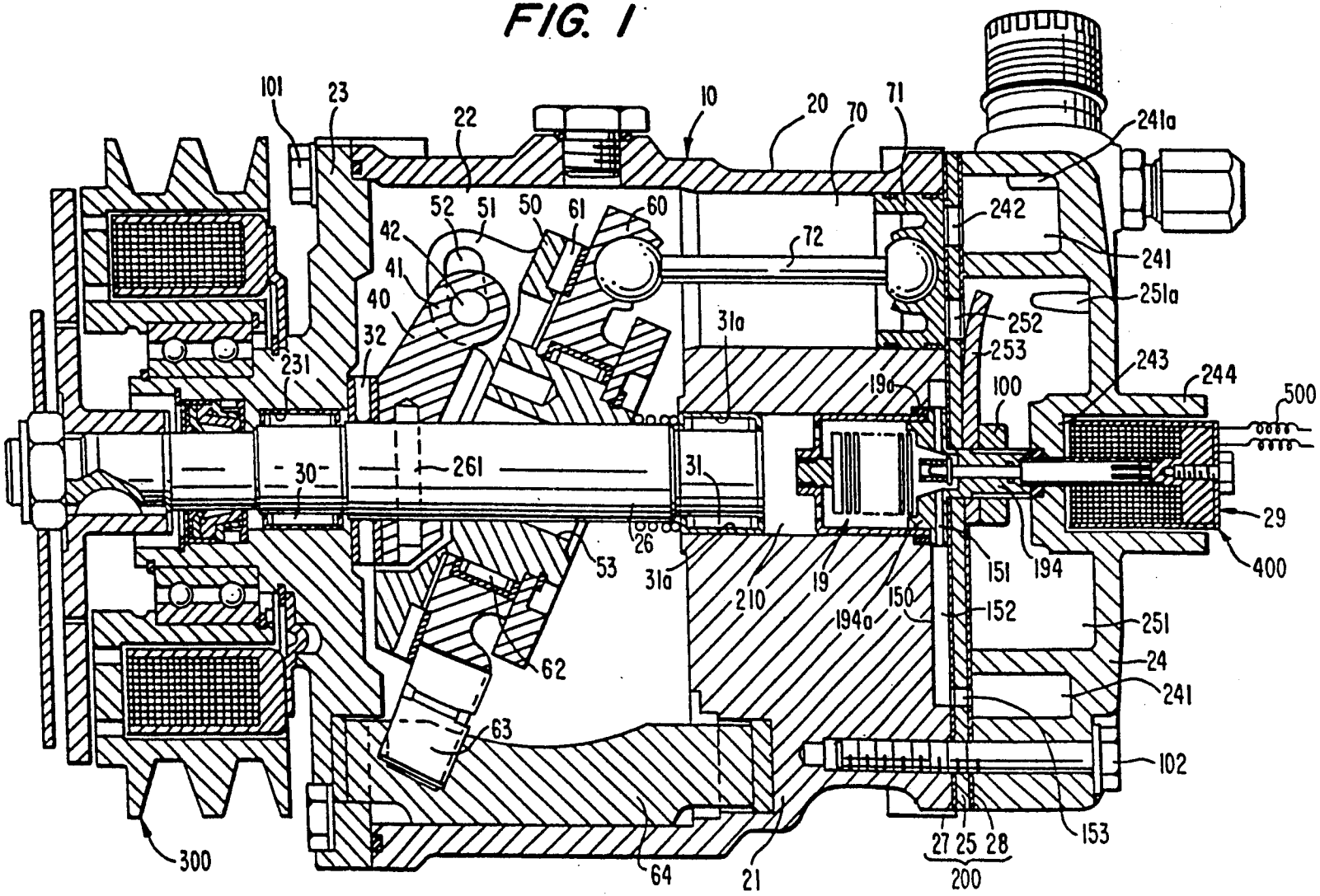
FIG. 1 is a vertical longitudinal sectional view of a slant plate type refrigerant compressor including a capacity control mechanism according to a first embodiment of this invention.

With reference to FIG. 1, the construction of a slant plate type compressor, specifically wobble plate type refrigerant compressor 10, including a capacity control mechanism in accordance with a first embodiment of the present invention is shown. Compressor 10 includes cylindrical housing assembly 20 including cylinder block 21, front end plate 23 disposed at one end of cylinder block 21, crank chamber 22 enclosed within cylinder block 21 by front end plate 23, and rear end plate 24 attached to the other end of cylinder block 21. Front end plate 23 is mounted on cylinder block 21 forward of crank chamber 22 by a plurality of bolts 101. Rear end plate 24 is mounted on cylinder block 21 at the opposite end by a plurality of bolts 102. Valve plate 25 is located between rear end plate 24 and cylinder block 21. Opening 231 is centrally formed in front end plate 23 for supporting drive shaft 26 by bearing 30 disposed therein. The inner end portion of drive shaft 26 is rotatably supported by bearing 31 disposed within central bore 210 of cylinder block 21. Bore 210 extends to a rearward end surface of cylinder block 21, and first valve control device 19 is disposed within bore 210.

Cam rotor 40 is fixed on drive shaft 26 by pin member 261 and rotates with shaft 26. Thrust needle bearing 32 is disposed between the inner end surface of front end plate 23 and the adjacent axial end surface of cam rotor 40. Cam rotor 40 includes arm 41 having pin member 42 extending therefrom. Slant plate 50 is disposed adjacent cam rotor 40 and includes opening 53. Drive shaft 26 is disposed through opening 53. Slant plate 50 includes arm 51 having slot 52. Cam rotor 40 and slant plate 50 are connected by pin member 42, which is inserted in slot 52 to create a hinged joint. Pin member 42 is slidable within slot 52 to allow adjustment of the angular position of slant plate 50 with respect to a plane perpendicular to the longitudinal axis of drive shaft 26.

Wobble plate 60 is nutatably mounted on slant plate 50 through bearings 61 and 62 which allow slant plate 50 to rotate with respect to wobble plate 60. Fork-shaped slider 63 is attached to the radially outer peripheral end of wobble plate 60 and is slidably mounted about sliding rail 64 disposed between front end plate 23 and cylinder block 21. Fork-shaped slider 63 prevents rotation of wobble plate 60, and wobble plate 60 nutates along rail 64 when cam rotor 40 and slant plate 50 rotate. Cylinder block 21 includes a plurality of peripherally located cylinder chambers 70 in which pistons 71 are disposed. Each piston 71 is connected to wobble plate 60 by a corresponding connecting rod 72. Nutation of wobble plate 60 causes pistons 71 to reciprocate in chambers 70.

Rear end plate 24 includes peripherally located annular suction chamber 241 and centrally located discharge chamber 251. Valve plate 25 includes a plurality of valved suction ports 242 linking suction chamber 241 with respective cylinders 70. Valve plate 25 also includes a plurality of valved discharge ports 252 linking discharge chamber 251 with respective cylinders 70. Suction ports 242 and discharge ports 252 are provided with suitable reed valves as discussed further below and also described in U.S. Pat. No. 4,011,029 to Shimizu, hereby incorporated by reference.

Suction chamber 241 includes inlet portion **241*a* which is connected to an evaporator (not shown) of the external cooling circuit. Discharge chamber 251 is provided with outlet portion 251*a* connected to a condenser (not shown) of the cooling circuit. Gaskets 27 and 28 are located between cylinder block 21 and the inner surface of valve plate 25, and the outer surface of valve plate 25 and rear end plate 24 respectively, to seal the mating surfaces of cylinder block 21, valve plate 25 and rear end plate 24**.

Figure 2:
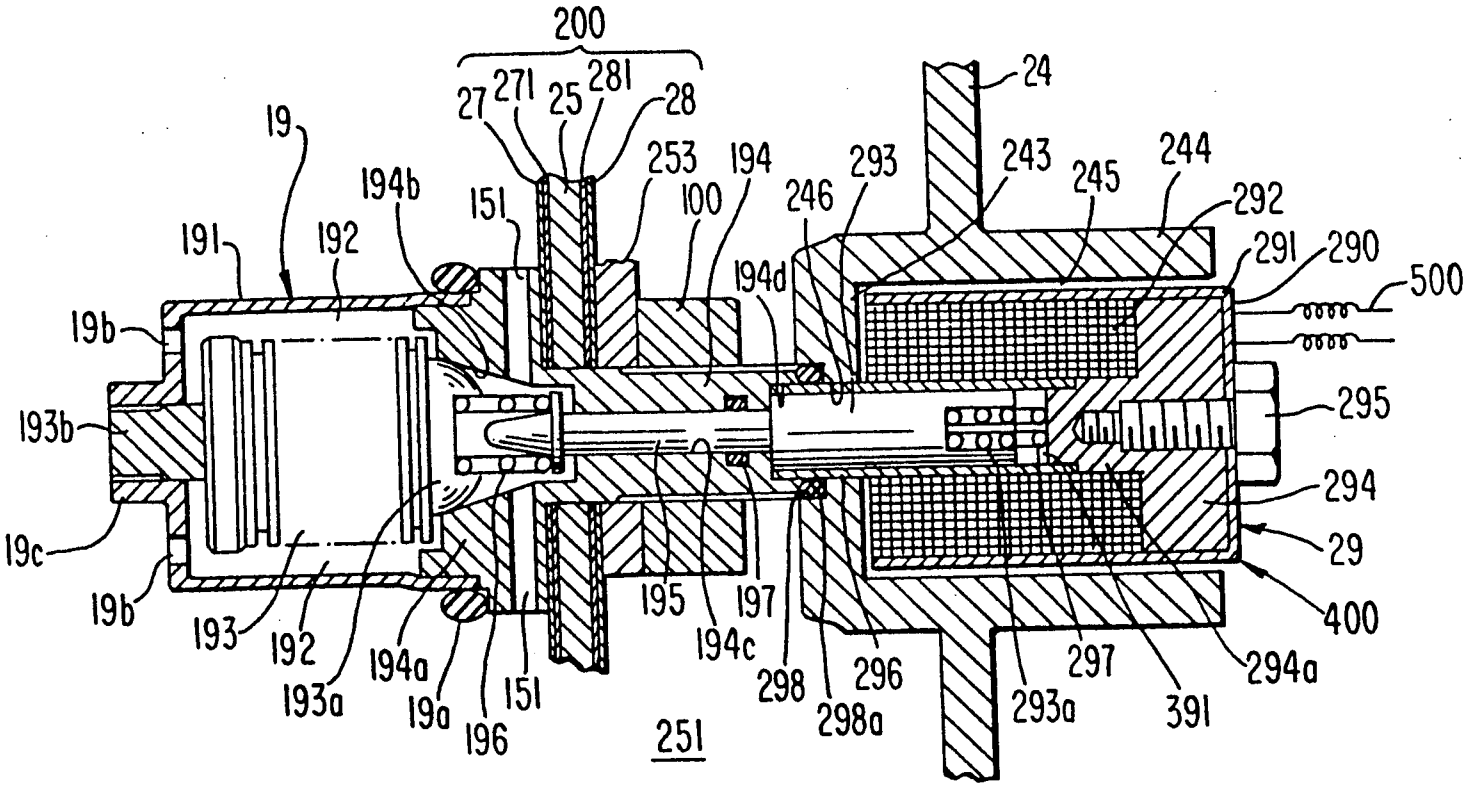
FIG. 2 is an enlarged partially sectional view of the capacity control mechanism shown in FIG. 1.

With further reference to FIG. 1 and to FIG. 2, capacity control mechanism 400 includes first valve control device 19 and second valve control device 29. First valve control device 19 includes cup-shaped casing member 191 disposed in central bore 210, and defining valve chamber 192 therein. O-ring **19*a* is disposed between an outer surface of casing member 191 and an inner surface of bore 210 to seal the mating surfaces of casing member 191 and cylinder block 21. A plurality of holes 19*b* are formed at a closed end of casing member 191, and crank chamber 22 is linked in fluid communication with valve chamber 192 through holes 19*b*, and small gaps 31*a* existing between bearing 31 and cylinder block 21. Thus, valve chamber 192 is maintained at the crank chamber pressure. Bellows 193 is fixedly disposed in valve chamber 192 and longitudinally contracts and expands in response to the crank chamber pressure. Projecting member 193*b* attached at the forward end of bellows 193 is secured to axial projection 19*c* formed at the center of the closed end of casing member 191. Valve member 193*a* is attached to the rearward end of bellows 193**.

Cylinder member 194 includes a cylinder-shaped rear part and integral valve seat **194*a* at the forward end of the cylinder-shaped rear part, and penetrates through valve plate assembly 200 which includes valve plate 25, gaskets 27, 28, suction reed valve 271 and discharge reed valve 281. Valve seat 194*a* is formed at the forward end of cylinder member 194 and is secured to the open end of casing member 191. Nut 100 is screwed on cylinder member 194 from the rearward end of cylinder member 194 which extends beyond valve plate assembly 200 and into discharge chamber 251. Nut 100 fixes cylinder member 194 to valve plate assembly 200, and valve retainer 253 is disposed between nut 100 and valve plate assembly 200. Conical shaped opening 194*b* is formed at valve seat 194*a*, and is linked to cylindrical channel 194*c* axially formed through cylinder member 194. Bore 194*d* is formed in the rearward end of cylinder member 194, and is opened to the rearward end of cylindrical channel 194*c*. Valve member 193*a* is disposed adjacent to valve seat 194*a*. Actuating rod 195 is slidably disposed within cylindrical channel 194*c*, and is linked to valve member 193*a* through bias spring 196. O-ring 197 is disposed in an annular channel formed in cylinder member 194 about cylindrical rod 195 to seal the mating surfaces of cylindrical channel 194*c* and actuating rod 195**.

Conduit 152 is formed at the axial end surface of cylinder block 21. Radial hole 151 is formed in cylinder member 194 at valve seat **194*a* and links conical shape opening 194*b* to one open end of conduit 152. Conduit 152 is linked to suction chamber 241 through hole 153 formed through valve plate assembly 200. Passageway 150, which provides communication between crank chamber 22 and suction chamber 241, is formed by gaps 31*a*, central bore 210, holes 19*b*, valve chamber 192, conical shaped opening 194*b*, radial hole 151, conduit 152 and hole 153. Accordingly, the opening and closing of passageway 150 is controlled by the contraction and expansion of bellows 193 in response to the crank chamber pressure, which causes valve member 193*a* to be moved into and out of opening 194*b* of valve seat 194*a***.

Rear end plate 24 is provided with circular depressed portion 243 formed at a central region thereof. Annular projection 244 projects rearwardly from the circumference of circular depressed portion 243. Annular projection 244 and circular depressed portion 243 cooperatively define cavity 245, and solenoid 290 is disposed therein.

Solenoid 290 includes cup-shaped casing member 291 which houses annular electromagnetic coil 292, cylindrical iron core 293 and pedestal member 294 made of magnetic material. Cylindrical iron core 293 is surrounded by annular electromagnetic coil 292, and pedestal member 294 is fixedly disposed at an inner closed end of cup-shaped casing member 291 by bolt 295. Pedestal 294 includes forward projecting portion **294*a* at a central location. Projecting portion 294*a* extends within coil 292 such that cavity 391 is maintained between the forward surface of portion 294*a* and the rear surface of iron core 293**.

Annular cylindrical member 296 is also disposed within coil 292, forward of projection portion **294*a* of pedestal 294. Annular cylindrical member 296 extends through hole 246 centrally formed through depressed portion 243. In construction of the compressor, cylindrical member 296 is forcibly inserted through hole 246 so as to be firmly secured thereto. Iron core 293 is slidably disposed within cylindrical member 296. The forward end of annular cylindrical member 296 extends into bore 194*d* and terminates adjacent the rearward end of cylindrical channel 194*c*. Cylindrical member 296, iron core 293, and bore 194*d* all have a radius which is greater than the radius of cylindrical channel 194*c*, such that iron core 293 may not slide within cylindrical channel 194*c*. However, when bellows 193 is expanded, actuating rod 195 may extend within cylindrical member 296 if iron core 293 has been moved rearwardly, as described further below. Annular indented region 298 is formed on a forward surface of depressed portion 243, about cylindrical member 296. O-ring 298*a* is disposed in annular indented region 298** and seals the mating surface of annular cylindrical member 296 and depressed portion 243, as well as the sealing surface of cylindrical member 194 and depressed portion 243.

The rearward end of annular cylindrical member 296 is disposed about the forward end of forward projecting portion 294*a* of pedestal 294, and is welded thereto to effectively isolate cavity 391. Cylindrical iron core 293 includes cylindrical cutout portion 293*a* which is centrally formed at a rearward end thereof, adjacent cavity 391. Bias spring 297 is disposed within cylindrical cutout portion 293*a* and is in contact with both the inner end surface of cylindrical cutout portion 293*a* at its forward end, and the forward end surface of forward projecting portion 294*a* of pedestal 294 at its rearward end. Therefore, bias spring 297 acts to bias the forward end of iron core 293 into contact with the rearward end of actuating rod 195, and thereby tends to urge actuating rod 195 forwardly within cylindrical channel 194*c*, should the rear end of actuating rod 195 extend beyond the end of channel 194*c* due to the bias provided by bias spring 196 and expansion of bellows 193. Of course, the extent of forward movement of iron core 293 is limited by the surface of bore 194*d*.

Wires 500 conduct electric power from an external electric power source (not shown) to electromagnetic coil 292 of solenoid 290. The magnitude of the current of the electric power supplied to solenoid 290 through wires 500 is varied in response to changes in the thermodynamic characteristics of the automobile air-conditioning system of which the compressor forms a part. For example, the temperature of the air leaving the evaporator, or the pressure of the refrigerant at the outlet of the evaporator, would be detected by suitable known detectors which would generate an appropriate signal in accordance with the magnitude of the detected quantity. The generated signal would be converted into a corresponding current supplied to coil 292 through wires 500. The detecting circuit for generating the current would be easily constructed by one skilled in the art and does not form part of this invention.

Second valve control device 29 is jointly formed by solenoid 290 and actuating rod 195. Control mechanism 400 includes first valve control device 19 which acts as a valve control responsive at a predetermined crank chamber pressure to control the opening and closing of the passageway, and second valve control device 29 which acts to adjust the pressure at which the first valve control device responds.

During operation of compressor 10, drive shaft 26 is rotated by the engine of the vehicle through electromagnetic clutch 300. Cam rotor 40 is rotated with drive shaft 26, rotating slant plate 50 as well, which causes wobble plate 60 to nutate. Nutational motion of wobble plate 60 reciprocates pistons 71 in their respective cylinders 70. As pistons 71 are reciprocated, refrigerant gas which is introduced into suction chamber 241 through inlet portion 241*a*, flows into eachcylinder 70 through suction ports 242 and is then compressed. The compressed refrigerant gas is discharged to discharge chamber 251 from each cylinder 70 through discharge ports 252, and therefrom into the cooling circuit through outlet portion 251*a*.

The capacity of compressor 10 is adjusted to maintain a constant pressure in suction chamber 241 in response to changes in the heat load of the evaporator or changes in the rotating speed of the compressor. The capacity of the compressor is adjusted by changing the angle of the slant plate, which is dependent upon the crank chamber pressure or more precisely, the difference between the crank chamber and suction chamber pressures. During operation of the compressor, the pressure of the crank chamber increases due to blow-by gas flowing past pistons 71 as they are reciprocated in cylinders 70. As the crank chamber pressure increases relative to the suction pressure, the slant angle of the slant plate and thus of the wobble plate decreases, decreasing the capacity of the compressor. A decrease in the crank chamber pressure relative to the suction pressure causes an increase in the angle of the slant plate and the wobble plate, and thus an increase in the capacity of the compressor. The crank chamber pressure is decreased whenever it is linked to the suction chamber due to contraction of bellows 193 and the corresponding opening of passageway 150.

The operation of first and second valve control devices 19 and 29 of compressor 10 in accordance with the first embodiment of the present invention is carried out in the following manner. When electromagnetic coil 292 receives an electric current through wires 500, a magnetic attraction force is generated which tends to move iron core 293 rearwardly against the restoring force of bias spring 297. Since the magnitude of the magnetic attraction force varies in response to changes in the magnitude of the electric current, the axial position of iron core 293 changes when the current is changed. Accordingly, the axial position of iron core 293 may be varied in response to changes in the signal representing the thermodynamic characteristic of the automobile air conditioning system. The change in the axial position of iron core 293 directly varies the axial position of actuating rod 195 when rod 195 is biased into a position where it extends beyond the end of channel 194*c*.

In operation of the compressor, the link between the crank and suction chambers is controlled by expansion or contraction of bellows 193 in response to the crank chamber pressure. As discussed above, bellows 193 is responsive at a predetermined pressure to move valve element 193*a* into or out of conical shaped opening 194*b*. However, whenever actuating rod 195 is forced to the left due to contact with iron core 293, rod 195 applies a leftward acting force on bellows 193 through bias spring 196 and valve member 193*a*. The leftward acting force provided by rod 195 tends to urge bellows 193 to contract, and thereby lowers the predetermined crank chamber response pressure at which the bellows contracts to open the passageway linking the crank and suction chambers. Since the crank chamber response pressure of the bellows is effected by the position of actuating rod 195, and the position of actuating rod 195 is itself effected by the position of iron core 293, the control of the link of the crank and suction chambers is responsive to the thermodynamic characteristics of the automobile air-conditioning system. That is, the response pressure of first valve control device 19 may be adjusted in accordance with changes in the thermodynamic characteristics of the automobile air conditioning circuit.

For example, when a current is applied through wires 500, iron core 293 is pulled to the right against the biasing force provided by bias spring 297, and actuating rod 195 may move freely to the right as well for a large extent without contacting and being constrained by iron core 293. Thus, the crank chamber response pressure of the bellows is either not depressed, or depressed only minimally when rod 195 finally contacts core 293. Of course, the degree to which rod 195 is free to move depends upon the magnitude of the applied current, and is at a maximum when core 293 contacts pedestal 294. When no current is applied to solenoid 290, iron core 293 is biased to its leftmost position by bias spring 297, and contacts the inner surface of bore 194*d*. Thus actuating rod 195 is prevented from assuming a position in which it would extend beyond the end of cylindrical channel 194*c*. Since iron core 293 is in its leftmost position, the maximum effect of iron core 293 on the position of actuating rod 195 is applied. Thus the leftward urging effect of actuating rod 195, which depresses the response pressure of bellows 193, is at a maximum. That is, when no electric current is applied to solenoid 292, the crank chamber response pressure of the bellows is decreased to the maximum extent. Accordingly, the crank chamber response pressure at which bellows 193 responds to open or close the passageway may be varied through a continuum, with the maximum and minimum values defined by the magnitude of the current applied to the solenoid, which is itself dependent upon the thermodynamic characteristics of the automobile air-conditioning system.

Additionally, in the present invention, the change in the axial position of actuating rod 195 is applied to bellows 193 through bias spring 196. Thus, the inertial forces which must be overcome when iron core 293 and actuating rod 195 move, as well as the frictional forces generated between the inner peripheral surface of cylindrical channel 194*c* and the outer peripheral surface of actuating rod 195, and between the inner peripheral surface of annular cylindrical member 296 and the outer peripheral surface of iron core 293, are eliminated due to the provision of bias spring 196. That is, the provision of bias spring 196 limits the extent to which rod 195 and core 293 must move in order to effect the response pressure of bellows 193. Accordingly, the tendency of the frictional and inertial forces to interfere with the smooth transference of force from iron core 293 to valve element 193*a* to adjust the response pressure of the bellows is significantly reduced. Since in normal operation, bellows 193 expands or contracts several hundred times during one second of compressor operation, the magnitude of the interference would be quite large and would act to significantly reduce the accuracy of the control provided by second valve control device 29, if bias spring 196 was not provided. Therefore, the provision of bias spring 196 allows the response pressure of first valve control device 19 to be accurately shifted in response to changes in the signal representing the thermodynamic characteristics of the automobile air-conditioning system.

Figure 3:
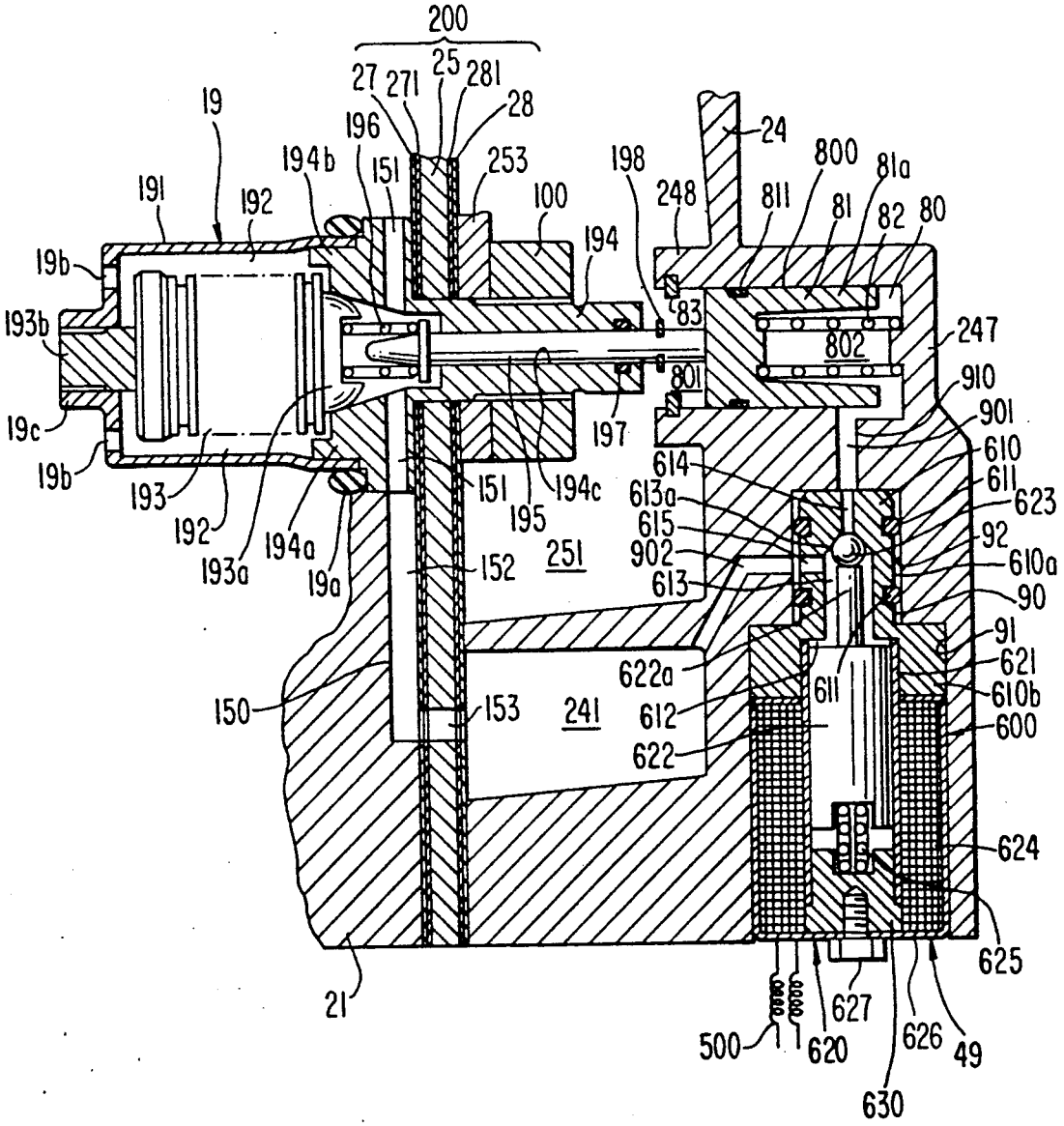
FIG. 3 is a view similar to FIG. 2 illustrating a capacity control mechanism according to a second embodiment of this invention.

FIG. 3 illustrates a valve control mechanism of a wobble plate type refrigerant compressor in accordance with a second embodiment of the present invention. In the drawing, the same numerals are used to denote the corresponding elements shown in FIGS. 1-2. Except where otherwise stated, the overall functioning of the compressor is the same as discussed above.

With reference to FIG. 3, rear end plate 24 is provided with integral rear protrusion 247. Protrusion 247 includes first and second cylindrical hollow portions 80 and 90. First cylindrical hollow portion 80 extends along the longitudinal axis of drive shaft 26 and is open to discharge chamber 251 at one end. Second cylindrical hollow portion 90 extends along a radius of rear end plate 24, perpendicular to the extending direction of first cylindrical hollow portion 80, and opens to the exterior of the compressor at one end. Portions 80 and 90 are linked by conduit 901.

Axial annular projection 248 projects forwardly from the open end of first cylindrical hollow portion 80, about the rear end portion of actuating rod 195 which extends outwardly beyond the end surface of cylinder member 194. Actuating piston element 81 is slidably disposed within hollow portion 80, thereby dividing portion 80 into front space 801 open to discharge chamber 251, and rear space 802 isolated from discharge chamber 251. Bias spring 82 is disposed between a closed end surface of hollow portion 80 and a rear end surface of actuating piston element 81, within flange portion 81*a*. Therefore, the forward end of actuating piston element 81 is normally maintained in contact with the rear end of actuating rod 195 and urges actuating rod 195 forwardly by virtue of the restoring force of bias spring 82. Piston ring 811 is disposed at an outer peripheral surface of actuating piston 81.

A plurality of stopper members 83 are fixedly attached to a forward end region of the inner peripheral surface of first cylindrical hollow portion 80, and prevent actuating piston element 81 from sliding out of hollow portion 80. A plurality of stopper members 198 are fixedly attached to the portion of actuating rod 195 which extends from the rearward end of cylindrical channel 194*c*, and prevent excessive forward movement of actuating rod 195, that is, the contact of stoppers 198 with the end surface of cylinder member 194 limits the forward movement of rod 195.

Second cylindrical hollow portion 90 includes large diameter hollow portion 91 and small diameter hollow portion 92 which is adjacent and extends from the inner end of large diameter hollow portion 91. Solenoid valve mechanism 600 is fixedly disposed within second cylindrical hollow portion 90 by, for example, forcible insertion. Solenoid valve mechanism 600 includes valve seat member 610 including smaller diameter portion 610*a* disposed within small diameter hollow portion 92, and integral larger diameter portion 610*b* disposed within an inner end region of large diameter hollow portion 91. Solenoid valve mechanism 600 also includes solenoid 620 which is substantially similar to solenoid 290 of the first embodiment, and which includes cylindrical iron core 622, annular electromagnetic coil 624, cup-shaped casing member 626, pedestal 630 and bias spring 625. Cylindrical iron core 622 and pedestal 630 are made of magnetic material. Cup-shaped casing member 626 houses annular electromagnetic coil 624. Cylindrical iron core 622 is surrounded by annular magnetic coil 624, and pedestal 630 is fixedly disposed at an inner closed end of cup-shaped casing member 626 by bolt 627. Stopper member 628 (shown in FIG. 5), for example, a snap ring, is fixedly attached to an outer end region of the inner peripheral surface of second cylindrical hollow portion 90, and prevents solenoid valve mechanism 600 from falling out of hollow portion 90. Bias spring 625 is disposed between core 622 and pedestal 630 and biases core 622 upwardly.

As in the first embodiment, wires 500 conduct electric power from an external electric power source (not shown) to electromagnetic coil 624 of solenoid 620. The magnitude of the current of the electric power supplied to solenoid 620 through wires 500 is varied in response to changes in the thermodynamic characteristics of the automobile air-conditioning system of which the compressor forms a part. For example, the temperature of the air leaving the evaporator, or the pressure at the outlet of the evaporator, would be detected by suitable known detectors which would generate an appropriate signal in accordance with the magnitude of the detected quantity. The generated signal would be converted into a corresponding current supplied to coil 624 through wires 500. The detecting circuit for generating the current would be easily constructed by one skilled in the art and does not form part of this invention.

Valve seat member 610 is provided with a pair of O-ring seals 611 to seal the mating surface of the inner peripheral surface of small diameter hollow portion 92 and the outer peripheral surface of valve seat member 610. Cylindrical depression 612 is formed in the interior of large diameter portion 610*b* of valve seat member 610 and annular cylindrical member 621 is fixedly disposed therein. Cylindrical cavity 613 extends from an inner end of cylindrical depression 612, and terminates about two-thirds of the way along valve seat member 610. Rod portion 622*a* is integrally formed with and projects from an inner end of iron core 622, and is disposed in cylindrical cavity 613. Conical valve seat 613*a* is formed at an inner end of cylindrical cavity 613, and receives ball member 623 which is disposed on an inner end of rod portion 622*a*.

First conduit 901 linking rear space 802 to small diameter hollow portion 92, and second conduit 902 linking suction chamber 241 to small diameter hollow portion 92, are formed in protrusion 247. Axial hole 614 is formed at an inner end portion of valve seat member 610. One end of axial hole 614 opens at the center of valve seat 613*a*, and the other end of axial hole 614 opens to one end of first conduit 901. Radial hole 615 is formed at a portion of valve seat member 610 located between O-ring seals 611. One end of radial hole 615 opens to cylindrical cavity 613 and the other open end of radial hole 615 opens to one end of second conduit 902. Accordingly, communication path 910 linking suction chamber 241 with rear space 802 of first cylindrical hollow portion 80 is formed by first conduit 901, axial hole 614, cylindrical cavity 613, radial hole 615 and second conduit 902.

In this embodiment, solenoid valve mechanism 600, communication path 910, bias spring 82, actuating piston 81 and actuating rod 195 jointly form second valve control device 49.

The operation of second valve control device 49 of the compressor in accordance with the the second embodiment of the present invention is carried out in the following manner. When electromagnetic coil 624 does not receive an electric current, no magnetic attraction force is generated which would tend to move iron core 622 downwardly. Iron core 622 moves upwardly by virtue of the restoring force of bias spring 625, thereby moving ball member 623 upwardly so that axial hole 614 is closed. Therefore, the pressure in rear space 802 is maintained at the discharge chamber pressure due to the flow of blow-by refrigerant gas from discharge chamber 251 into rear space 802 through gaps 800 formed between the inner peripheral surface of first cylindrical hollow portion 80 and the outer peripheral surface of actuating piston element 81. Gaps 800 are small and are inherently maintained due to the fact that actuating piston element 81 is slidably disposed within portion 80. Accordingly, no pressure difference between rear space 802 and front space 801 is generated, and no net force due to the gas pressure acts on actuating piston element 81. Therefore, actuating piston element 81 moves forwardly to the maximum forward position by virtue of the restoring force of bias spring 82.

However, when electromagnetic coil 624 receives a current through wires 500, a magnetic attraction force is generated which tends to move iron core 622 downwardly against the restoring force of bias spring 625, and ball member 623 moves downwardly as well due to the discharge chamber pressure which acts on the surface of ball 623 which faces axial hole 614, as well as gravity, thereby opening axial hole 614. As a result, the refrigerant gas in rear space 802 flows into suction chamber 241 through first conduit 901, axial hole 614, cylindrical cavity 613, radial hole 615 and second conduit 902, and the pressure in rear space 802 decreases to the pressure in suction chamber 241. Accordingly, the pressure difference between rear space 802 and front space 801 is maximized, and a maximum net force acts on piston element 81 and urges actuating piston element 81 rearwardly. Therefore, actuating piston element 81 moves rearwardly to the maximum rearward position against the restoring force of bias spring 82.

The axial position of iron core 622 varies in response to changes in the magnitude of the electric current, and the change in the axial position of iron core 622 varies the extent to which axial hole 614 is open, and thereby further varies the pressure in rear space 802. Therefore, the pressure in rear space 802 varies from the discharge pressure to the suction pressure in accordance with the applied current. Thus, the pressure difference between rear space 802 and front space 801 is varied in accordance with the applied current. The change in the pressure difference between rear space 802 and front space 801 varies the force which tends to rearwardly urge actuating piston element 81. As a result, the axial position of actuating piston element 81 varies from a maximum forward position to a maximum rearward position in response to a change in the value of a signal representing the thermodynamic characteristic of the automobile air-conditioning system. As similarly described with respect to the first embodiment, a change in the axial position of actuating piston element 81 directly varies the axial position of actuating rod 195 to adjust the crank chamber response pressure point of bellows 193.

As in the above embodiments, the force provided by rod 195 is smoothly transferred to forwardly urge valve member 193*a* through bias spring 196, and the provision of bias spring 196 effectively prevents the inertia force generated by the movement of actuacting piston element 81 and actuating rod 195, and the frictional force generated between the inner peripheral surface of cylindrical channel 194*c* and the outer peripheral surface of actuating rod 195, and between the inner peripheral surface of first cylindrical hollow portion 80 and the outer peripheral surface of actuating piston element 81, from interfering with accurate control of the crank chamber response pressure of the bellows. Accordingly, in the second embodiment of the present invention, the response pressure of first valve control device 19 is accurately shifted in response to changes in the value of a signal representing the thermodynamic characteristic of the automobile air-conditioning system.

Furthermore, the degree of freedom regarding the design of first valve control device 19 is increased in the second embodiment as compared with the first embodiment of the invention, since the axial position of actuating rod 195 is indirectly controlled by solenoid 620.

That is, bias spring 82 and piston element 81 are interposed between actuating rod 195 and solenoid 620. Accordingly, if it is desired to increase the spring constant of bias spring 196, it is not necessary to increase the size of the solenoid by increasing the number of windings of the coil since the solenoid valve does not act directly on rod 195. Rather, since solenoid 620 acts only to control the flow of fluid from rear space 802, the size of the solenoid need not be increased to accommodate an increase in the size of spring 196.

Figure 4:
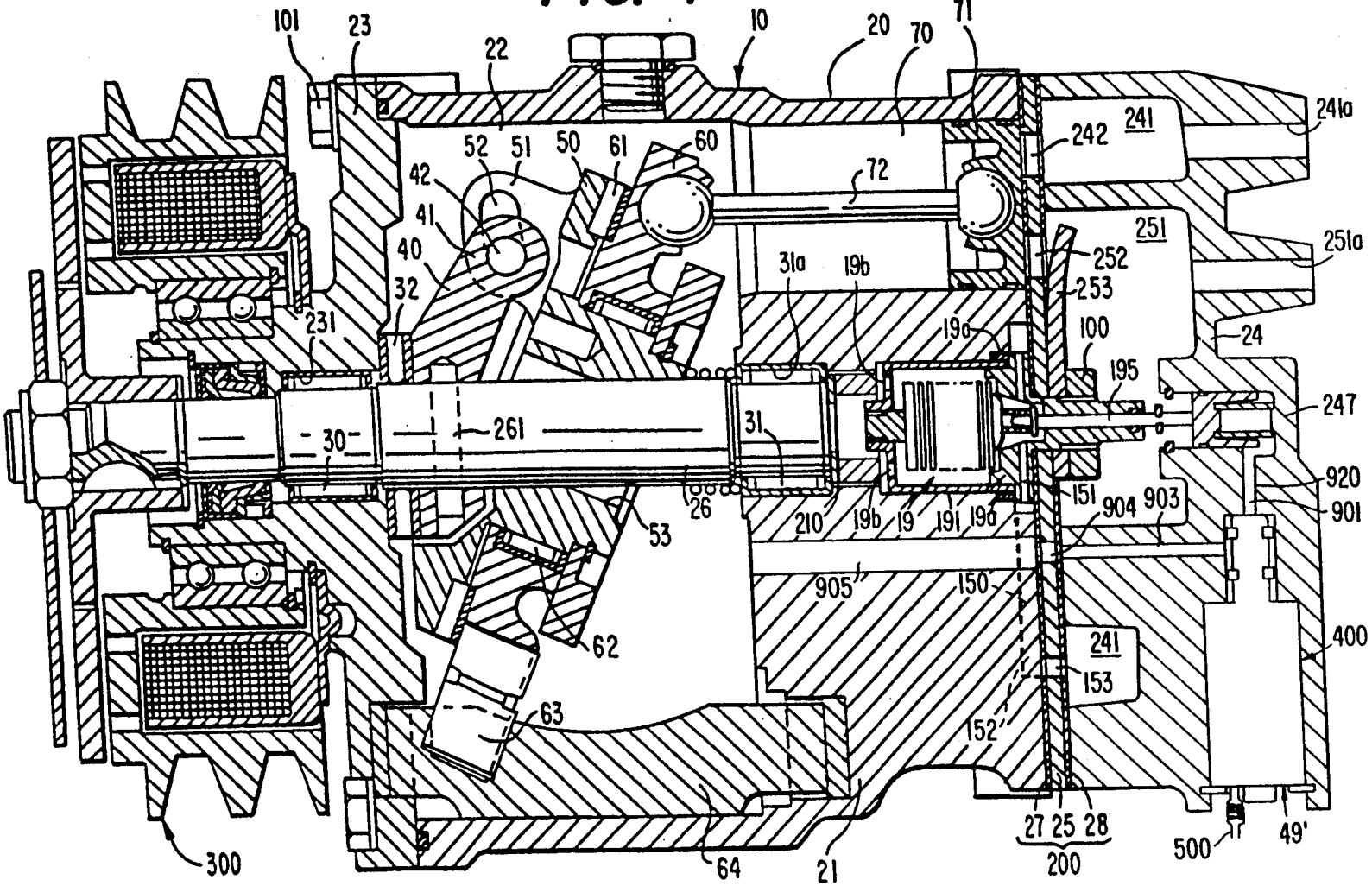
FIG. 4 is a vertical longitudinal sectional view of a slant plate type refrigerant compressor including a capacity control mechanism according to a third embodiment of this invention.
Figure 5:
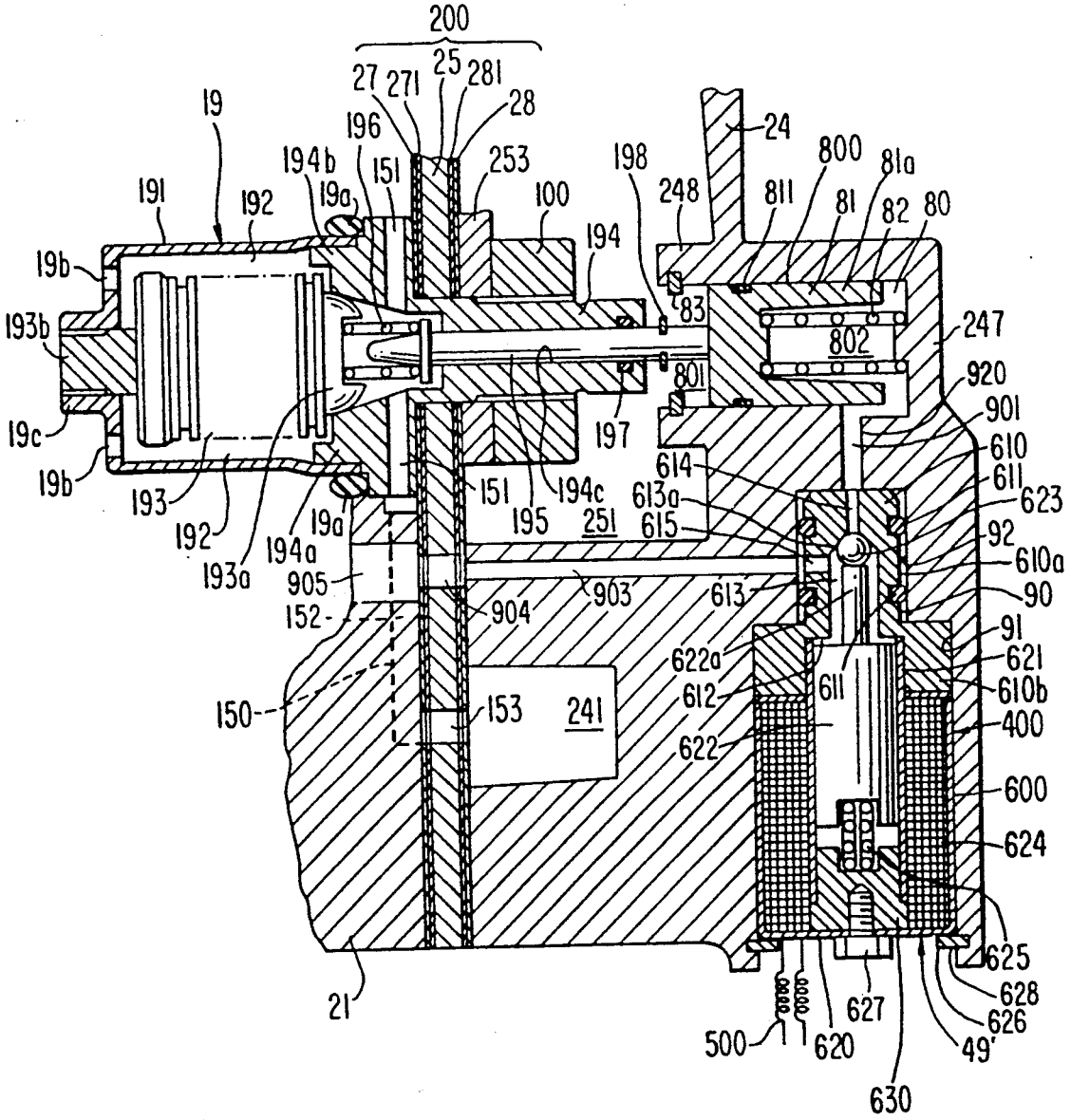
FIG. 5 is an enlarged partially sectional view of the capacity control mechanism shown in FIG. 4.

With respect to FIGS. 4 and 5, a third embodiment of the present invention is shown. The third embodiment is similar to the second embodiment, and like reference numerals are used to denote identical elements shown in all of FIGS. 1-3. Except as otherwise stated, the overall functioning of the compressor is also identical to the functioning described above with respect to the first two embodiments.

In the third embodiment, rear space 802 is in fluid communication with the crank chamber instead of with the suction chamber, as in the second embodiment. In particular, in valve control device 49' of the third embodiment, one end of radial hole 615 opens to cylindrical cavity 613 and the other open end of radial hole 615 opens to one end of second conduit 903, which is axially formed in rear end plate 24. The other end of second conduit 903 opens to hole 904 which is formed through valve plate assembly 200. Third conduit 905 is axially formed in cylinder block 21. One end of third conduit 905 opens to hole 904 and the other end of third conduit 905 opens to crank chamber 22. Accordingly, communication path 920 linking crank chamber 22 with rear space 802 of first cylindrical hollow portion 80 is formed by first conduit 901, axial hole 614, cylindrical cavity 613, radial hole 615, second conduit 903, hole 904 and third conduit 905.

As with the second embodiment, during operation of the compressor, when electromagnetic coil 624 receives the electric current through wires 500, a magnetic force is generated which tends to move iron core 622 downwardly against the restoring force of bias spring 625, and ball member 623 moves downwardly as well due to the discharge pressure which acts on the surface of ball 623 which faces axial hole 614, as well as gravity, thereby opening axial hole 614. As a result, the refrigerant gas flowing from discharge chamber 251 to rear space 802 through gaps 800 further flows into crank chamber 22 through first conduit 901, axial hole 614, cylindrical cavity 613, radial hole 615, second conduit 903, hole 904 and third conduit 905. The flow rate of the refrigerant gas from rear space 802 to crank chamber 22 is much greater than the flow rate of the refrigerant gas from discharge chamber 251 to rear space 802. Therefore, the pressure in rear space 802 decreases to the pressure in crank chamber 22. Accordingly, the pressure difference between rear space 802 and front space 801 is maximized, and a maximum net forces acts on actuating piston element 81 and urges actuating piston element 81 rearwardly to the maximum rearward position against the restoring force of bias spring 82.

The axial position of iron core 622 varies in response to a change in the magnitude of the electric current, and the change in the axial position or iron core 622 varies the extent to which axial hole 614 is open, and thereby further varies the pressure in rear space 802. Therefor, the pressure in rear space 802 varies from the discharge chamber pressure to the crank chamber pressure in accordance with the applied current. Thus, the pressure difference between rear space 802 and front space 801 is varied in accordance with the applied current. The change in the pressure difference between rear space 802 and front space 801 varies the force which tends to rearwardly urge actuating piston element 81. As a result, the axial position of actuating piston element 81 varies from a maximum forward position to a maximum rearward position in response to a change in the value of a signal representing the thermodynamic characteristic of the automobile air-conditioning system. As similarly described with respect to the second embodiment, a change in the axial position of actuating piston element 81 directly varies the axial position of actuating rod 195 to adjust the crank chamber response pressure point of bellows 193.

Furthermore, since the refrigerant gas in discharge chamber 251 flows to crank chamber 22 through gaps 800 and communication path 920, whenever passageway 150 is blocked due to expansion of bellows 193, the rate of increase in the pressure in crank chamber 22 when axial hole 614 is opened is increased as compared with the second embodiment in which rear space 802 is linked with the suction chamber. That is, in the second embodiment the increase in crank chamber pressure occurs only due to blow-by gas while in the third embodiment the crank chamber pressure increases due to both the blow-by gas and the flow of high pressure gas from rear space 802 to crank chamber 22. Thus, the capacity of the compressor is decreased more quickly in the third embodiment than in the second embodiment in accordance with an external signal acting to open hole 614 by moving iron core 622 downwardly.

Compressors of the type disclosed in the present invention may be used in automobile air-conditioning systems in which the air conditioning demand frequently changes. For example, the demand on the air-conditioning system may be quickly reduced, requiring a quick reduction in the capacity of the compressor for efficient operation. Accordingly, the compressor as disclosed in the third embodiment is particularly useful in automobile air-conditioning systems since the capacity of the compressor may be quickly reduced when desired in accordance with the external signal, due to the link of rear space 802 with crank chamber 22.

Figure 6:
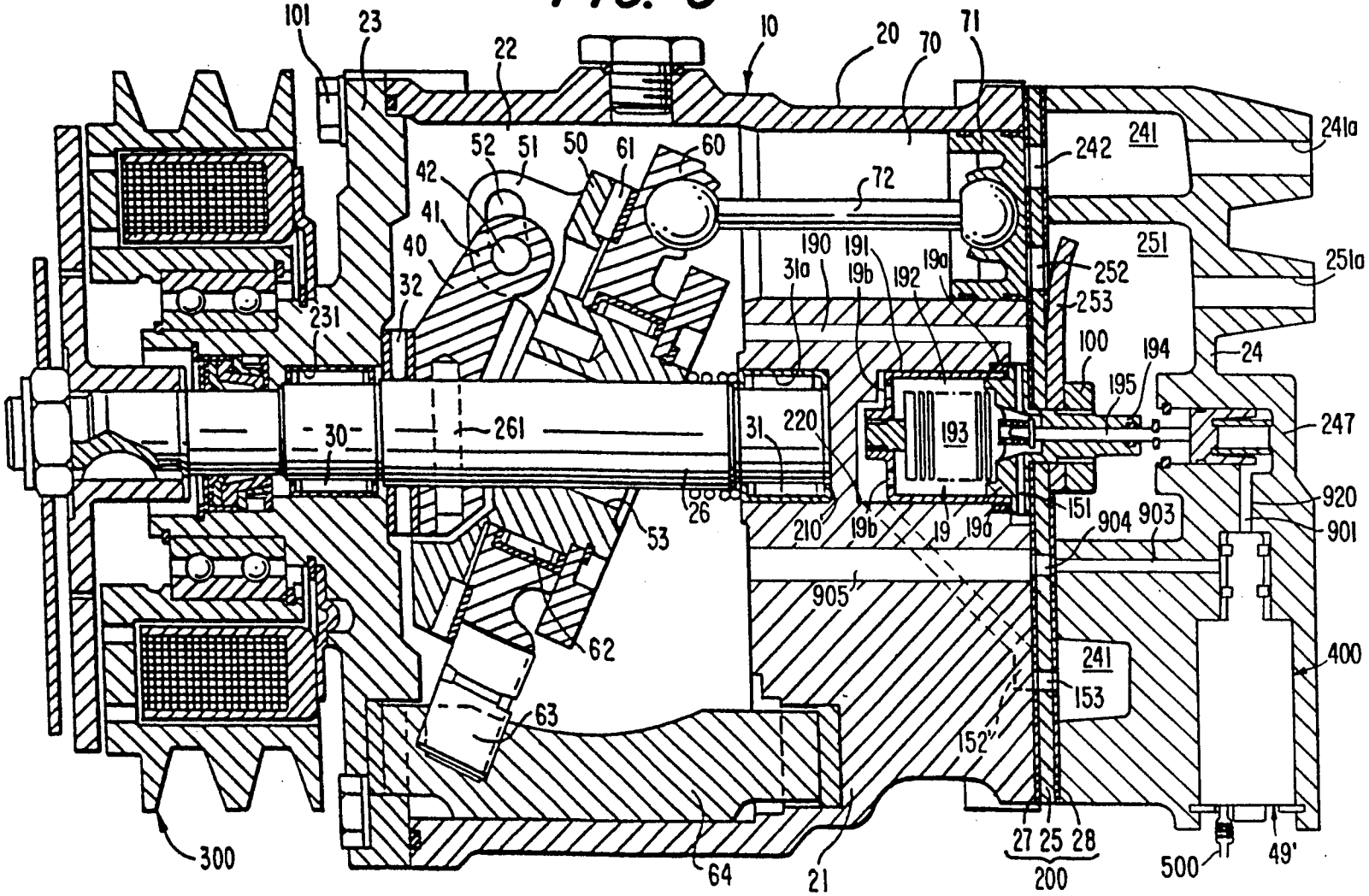
FIG. 6 is a vertical longitudinal sectional view of a slant plate type refrigerant compressor including a capacity control mechanism according to a fourth embodiment of this invention.

With reference to FIG. 6, a fourth embodiment of the present invention is disclosed. The fourth embodiment is identical to the third embodiment with the exception that bellows 193 is disposed so as to be responsive to the suction pressure. Specifically, central bore 210' terminates before the location of casing 191, and casing 191 is disposed in bore 220 which is isolated from bore 210' and thus from crank chamber 22. Conduit 152' is formed in cylinder block 21. One end of conduit 152' opens to bore 220 and the other end of conduit 152' opens to hole 153 formed through valve plate assembly 200. Bore 220 is linked to suction chamber 241 through conduit 152' and hole 153. Thus, valve chamber 192 is maintained at the suction pressure by hole 153, conduit 152', bore 220 and holes **19*b*, and bellows 193 is is responsive to the suction pressure. Additionally, conduit 151 formed through cylinder member 194 is linked to crank chamber 22 through conduit 190 also formed through cylinder block 21. Thus, bellows 193 is responsive to the suction pressure to expand or contract and thereby open or close the passageway linking the crank and suction chambers. Second valve control device 49'** is identical in structure and function to the third embodiment, and acts to shift the suction pressure response point of bellows 193 in accordance with the thermodynamic characteristics of the automotive air conditioning system as discussed above.

This invention has been described in connection with the preferred embodiments. These embodiments, however, are merely for example only and the invention is not restricted thereto. It will be understood by those skilled in the art that variations and modifications can easily be made within the scope of this invention as defined by the claims.

We claim:

1. In a slant plate type refrigerant compressor including a compressor housing enclosing a crank chamber, a suction chamber and a discharge chamber therein, said compressor housing comprising a cylinder block having a plurality of cylinders formed therethrough, a piston slidably fitted within each of said cylinders, a drive means coupled to said pistons for reciprocating said pistons within said cylinders, said drive means including a drive shaft rotatably supported in said housing and coupling means for drivingly coupling said drive shaft to said pistons such that rotary motion of said drive shaft is converted into reciprocating motion of said pistons, said coupling means including a slant plate having a surface disposed at an adjustable inclined angle relative to a plane perpendicular to said drive shaft, the inclined angle of said slant plate adjustable to vary the stroke length of said pistons in said cylinders to vary the capacity of the compressor, a passageway formed in said housing and linking said crank chamber and said suction chamber in fluid communication, and capacity control means for varying the capacity of the compressor by adjusting the inclined angle, said capacity control means including a first valve control means and a response pressure adjusting means, said first valve control means for controlling the opening and closing of said passageway in response to changes in refrigerant pressure in said compressor to control the link between said crank and said suction chambers to thereby control the capacity of the compressor, said first valve control means responsive at a predetermined pressure, said response pressure adjusting means for controllably changing the predetermined pressure at which said first valve control means responds, the improvement comprising:

said response pressure adjusting means including a hollow portion, a piston element disposed in said hollow portion and dividing said hollow portion into a first space open to said discharge chamber and a second space isolated from said discharge chamber, said first and second spaces linked by a gap between the inner surface of said hollow portion and an outer surface of said piston element, said piston element linked to said first valve control means, a communicating path linking said second space with said crank chamber, and a second valve control means for controlling the link of said second space to said crank chamber, said second valve control means functioning in response to an external signal to vary the pressure in said second space between the discharge pressure and the crank pressure.

2. The compressor recited in claim 1, said piston element disposed adjacent an actuating rod, said actuating rod linked to said first valve control means by a first elastic element.

3. The compressor recited in claim 2, said second valve control means comprising a solenoid actuator.

4. The compressor recited in claim 2, further comprising a second elastic element, said second elastic element disposed in said second space and biasing said piston element towards said actuating rod.

5. The compressor recited in claim 2, said first valve control means comprising a longitudinally expanding and contracting bellows and a valve element attached at one end of said bellows, said actuating rod having one end disposed adjacent said piston element.

6. The compressor recited in claim 5, further comprising a second elastic element, said second elastic element disposed in said second space and biasing said piston element towards said actuating rod.

7. The compressor recited in claim 1, said response pressure adjusting means further comprising a second hollow portion linked by a channel to said second space of said first hollow portion, said second hollow portion linked to said crank chamber, and a solenoid actuator disposed in said second hollow portion, said solenoid actuator controlling the opening and closing of said channel to control the link of said second space and said crank chamber in response to an external signal.

8. The compressor recited in claim 1, said compressor forming part of a refrigeration circuit, said response pressure adjusting means responding to a thermodynamic characteristic of the refrigeration circuit.

9. The compressor recited in claim 8, the refrigeration circuit comprising an evaporator, wherein the thermodynamic characteristic is the temperature of the air passing through and exiting the evaporator.

10. The compressor recited in claim 8, the refrigeration circuit comprising an evaporator, wherein the thermodynamic characteristic is the pressure of the refrigerant exiting the evaporator.

11. The compressor recited in claim 1, said first valve control means responsive to the suction chamber pressure.

12. The compressor recited in claim 1, said first valve control means responsive to the crank chamber pressure.

13. In a slant plate type refrigerant compressor including a compressor housing enclosing a crank chamber, a suction chamber and a discharge chamber therein, said compressor housing comprising a cylinder block having a plurality of cylinders formed therethrough, a piston slidably fitted within each of said cylinders, a drive means coupled to said pistons for reciprocating said pistons within said cylinders, said drive means including a drive shaft rotatably supported in said housing and coupling means for drivingly coupling said drive shaft to said pistons such that rotary motion of said drive shaft is converted into reciprocating motion of said pistons, said coupling means including a slant plate having a surface disposed at an adjustable inclined angle relative to a plane perpendicular to said drive shaft, the inclined angle of said slant plate adjustable to vary the stroke length of said pistons in said cylinders to vary the capacity of the compressor, a passageway formed in said housing and linking said crank chamber and said suction chamber in fluid communication, and capacity control means for varying the capacity of the compressor by adjusting the inclined angle, said capacity control means including a valve control means and a response pressure adjusting means, said valve control means for controlling the opening and closing of said passageway in response to changes in refrigerant pressure in said compressor to control the link between said crank and said suction chambers to thereby control the capacity of the compressor, said valve control means responsive at a predetermined pressure, said response pressure adjusting means for controllably changing the predetermined pressure at which said first valve control means responds, the improvement comprising:

said response pressure adjusting means including a moveable element linked to said valve control means, said moveable element moving in response to a comparison of the pressure on the opposite sides thereof, one side of said moveable element linked in fluid communication with said crank chamber, and pressure control means for controlling the pressure on said one side of said moveable element by controlling the link of said one side with said crank chamber, said pressure control means responsive to an external signal.

14. The compressor recited in claim 13, said one side of said moveable element linked in fluid communication with said crank chamber by a conduit, said pressure control means controlling the opening and closing of said conduit in response to the external signal.

15. The comprssor recited in claim 14, the opposite side of said moveable element linked to said valve control means by an elastic element, the opposite side also linked in fluid communication with said discharge chamber.

16. The compressor recited in claim 13, said valve control means responsive to the suction pressure.

17. The compressor recited in claim 13, said valve control means responsive to the crank pressure.

* * * * *